US006972678B2

(12) United States Patent
Houston et al.

(10) Patent No.: US 6,972,678 B2
(45) Date of Patent: Dec. 6, 2005

(54) WIRELESS-BASED SYSTEM AND METHOD FOR HULL-BASED SENSING

(75) Inventors: Brian H. Houston, Fairfax, VA (US); Geoffrey L. Main, Vienna, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 248 days.

(21) Appl. No.: 10/208,840

(22) Filed: Aug. 1, 2002

(65) Prior Publication Data

US 2004/0021564 A1 Feb. 5, 2004

(51) Int. Cl.[7] ..... H04Q 7/00

(52) U.S. Cl. ..... 340/539.1; 340/854.6; 340/539.2; 340/851; 367/87; 324/323

(58) Field of Search ..... 340/539.1, 539.2, 340/851, 850, 853.2, 853.3, 854.1, 854.6, 854.7, 854.8, 855.6, 856.4; 367/87; 324/323; 385/12

(56) References Cited

U.S. PATENT DOCUMENTS

| | | | | | |
|---|---|---|---|---|---|
| 4,032,868 | A | * | 6/1977 | Trudeau | 333/252 |
| 4,599,745 | A | | 7/1986 | Baran et al. | |
| 5,047,990 | A | | 9/1991 | Gafos et al. | |
| 5,126,978 | A | * | 6/1992 | Chaum | 367/135 |
| 5,452,265 | A | | 9/1995 | Corsaro | |
| 5,642,445 | A | * | 6/1997 | Bucaro et al. | 385/12 |
| 5,859,812 | A | | 1/1999 | Sullivan et al. | |
| 6,043,917 | A | | 3/2000 | Sonderegger et al. | |
| 6,046,963 | A | | 4/2000 | Glenning | |
| 6,115,681 | A | | 9/2000 | Foreman et al. | |
| 6,351,717 | B2 | | 2/2002 | Lambrecht | |
| 6,370,085 | B1 | | 4/2002 | Finkle | |
| 6,439,941 | B2 | * | 8/2002 | McClure et al. | 441/89 |

* cited by examiner

*Primary Examiner*—Jeffery Hofsass
*Assistant Examiner*—Daniel Previl
(74) *Attorney, Agent, or Firm*—John J. Karasek; Sally A. Ferrett

(57) ABSTRACT

The present invention describes a wireless system and method for distributing sensors in large numbers that makes possible the application of a number of algorithms for the extraction of important physical quantities. More specifically, the method involves (a) formation of an electromagnetic waveguide by the application of a polymer, or other dielectric material, on the exterior of the hull of a vessel; (b) insertion of sensors/radio units within the waveguide, the sensors being arranged to sample the fields of interest; and (c) insertion of radio transceiver base stations in the waveguide to communicate and extract data from the sensor/radio units. The wireless system of the present invention is implemented with a very high sensor count whose outputs are processed to recover exterior field quantities without the requirement of direct measurements off of the vessel's structure.

22 Claims, 3 Drawing Sheets

WIRELESS-BASED SYSTEM AND METHOD FOR HULL-BASED SENSING

BACKGROUND OF THE INVENTION

1. Field of the Invention

This invention relates to shipboard sensing, and more particularly, to an apparatus and method for making spatially dense measurements of physical quantities.

2. Description of Related Art

The current state-of-the-art includes a large number of commercial and defense applications of hull-based sensors. These include, for example, arrays of sensors attached to the exterior of submarines, surface ships, towed underwater vehicles, Autonomous Underwater vehicles (AUV), and Underwater Unmanned Vehicles (UUV).

Naval tacticians and oceanographers appreciate the complexity of the ocean environment, but have had limited capability to measure and analyze its complexity in-situ. Onboard naval ships, submarines, and aircraft (i.e., naval platforms) this limited capability has been particularly true. Most acoustic propagation predictions and dependent tactical algorithms use as inputs averaged historical and infrequently collected in-situ data. These data are generalized as being representative of the surrounding ocean volume. The clear need for detailed local environmental information is reflected in current U.S. Navy systems such as the Tactical Oceanographic Monitoring System (TOMS), Improved Oceanographic Sensor (IOS), and Anti-Submarine Warfare Tactical Decision Aid (ASWTDA). The first two systems provide continuous data collection from hull-based sensors, and simple parameter time displays. ASWTDA uses a batch processing technique to provide area-wide predictions of a limited number of oceanographic parameters based primarily on historical and limited in situ data from oceanographic sensor systems like the expendable bathythermographs (XBT).

The above-identified systems having hull-based sensors are limited, however, in performance and by cost due to a requirement to employ the use of conventionally wired and/or optical buss structures for the communication of data. Further, the development and deployment of distributed monitoring and control of the sensors has been hindered in the past by the requirements of complex installation and communication network requirements. Conventional distributed sensors require cable interface, and consequently required extensive modification to structures for sensor installation.

SUMMARY OF THE INVENTION

The present invention solves the above-identified problems of prior-art systems. Specifically, the present invention enables determining spatially dense measurements of physical quantities on the exterior of a vessel, at a structure-fluid interface, without the requirements of interconnecting the instrumentation with cabling.

In a preferred embodiment, the present invention describes a wireless system and method for distributing sensors in large numbers that enables the application of a number of algorithms to extract data related to physical quantities. More specifically, the method involves (a) formation of an electromagnetic waveguide by the application of a polymer, or other dielectric material, on the exterior of the hull of a vessel; (b) insertion of sensors/radio units within the waveguide, the sensors being arranged to sample the fields of interest; and (c) insertion of radio transceiver base stations in the waveguide to communicate and extract data from the sensor/radio units. The wireless system is preferably implemented with a very high sensor count whose outputs are processed to recover exterior field quantities without the requirement of direct measurements off of the vessel's structure.

In one aspect, the present invention provides a system for performing spatially dense measurements of physical quantities, comprising an electromagnetic waveguide formed on an external surface of a vessel; a plurality of wireless sensors disposed within the electromagnetic waveguide for sampling the physical quantities and receiving physical measurements; and one or more radio receivers disposed within the waveguide for communicating with the plurality of wireless sensors and extracting the physical measurements therefrom. The spatially dense measurements are preferably performed exterior of the vessel and at a structure-fluid interface. The plurality of sensors are capable of supporting spatial sampling demanded by structural acoustics of the vessel and are preferably arranged on a structural surface of the vessel in the form of cells. The plurality of sensors have radio/communication capabilities. The electromagnetic waveguide provides a communication medium in an operating range that is preferably from about 1 MHz to about 10 GHz.

The electromagnetic waveguide is preferably planar in configuration such that the curvature of the waveguide is less than the electromagnetic wavelength of the waveguide. The electromagnetic waveguide comprises a dielectric layer and one or more conductive layers sandwiching the dielectric layer. The plurality of sensors are disposed within the dielectric layer to sample physical quantities exterior of the vessel. Information received by the plurality of sensors is communicated to a central processing station via radio frequency communication. The physical quantities include at least one of hydrostatic pressure, temperature, electric and magnetic fields, and dynamic and static accelerations.

In another aspect, the present invention provides a method for performing spatially dense measurements of physical quantities, the method comprising forming an electromagnetic waveguide on an external surface of a vessel; providing a plurality of wireless sensors within the electromagnetic waveguide for sampling physical quantities outside of the vessel and receiving data related to the physical quantities; and providing one or more radio receivers within said waveguide for communicating with said plurality of sensors and extracting the received data therefrom.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE EXEMPLARY EMBODIMENTS

Figure 1:
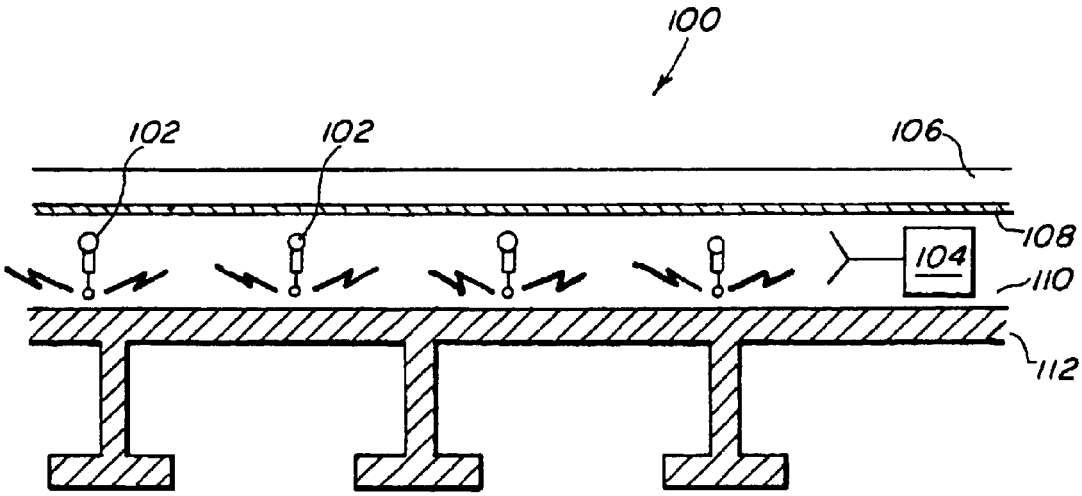
FIG. 1 is a schematic illustrating a planar waveguide that is formed on the outer surface of a hull of a vessel in an exemplary embodiment of the present invention.

DEFINITION(S): As used herein, when reference is made to a sensor(s) as being disposed within a waveguide or electromagnetic waveguide, this includes the positioning of just some portion of the sensor in the waveguide, e.g. the antenna, while another portion of the sensor, e.g. the body, may be disposed outside the waveguide, as when the antenna is projecting into the waveguide with the base or body portion of the sensor not disposed therein.

In the drawings, like or similar elements are designated with identical reference numerals through the drawings, and the various elements depicted are not necessarily drawn to scale.

Figure 3:
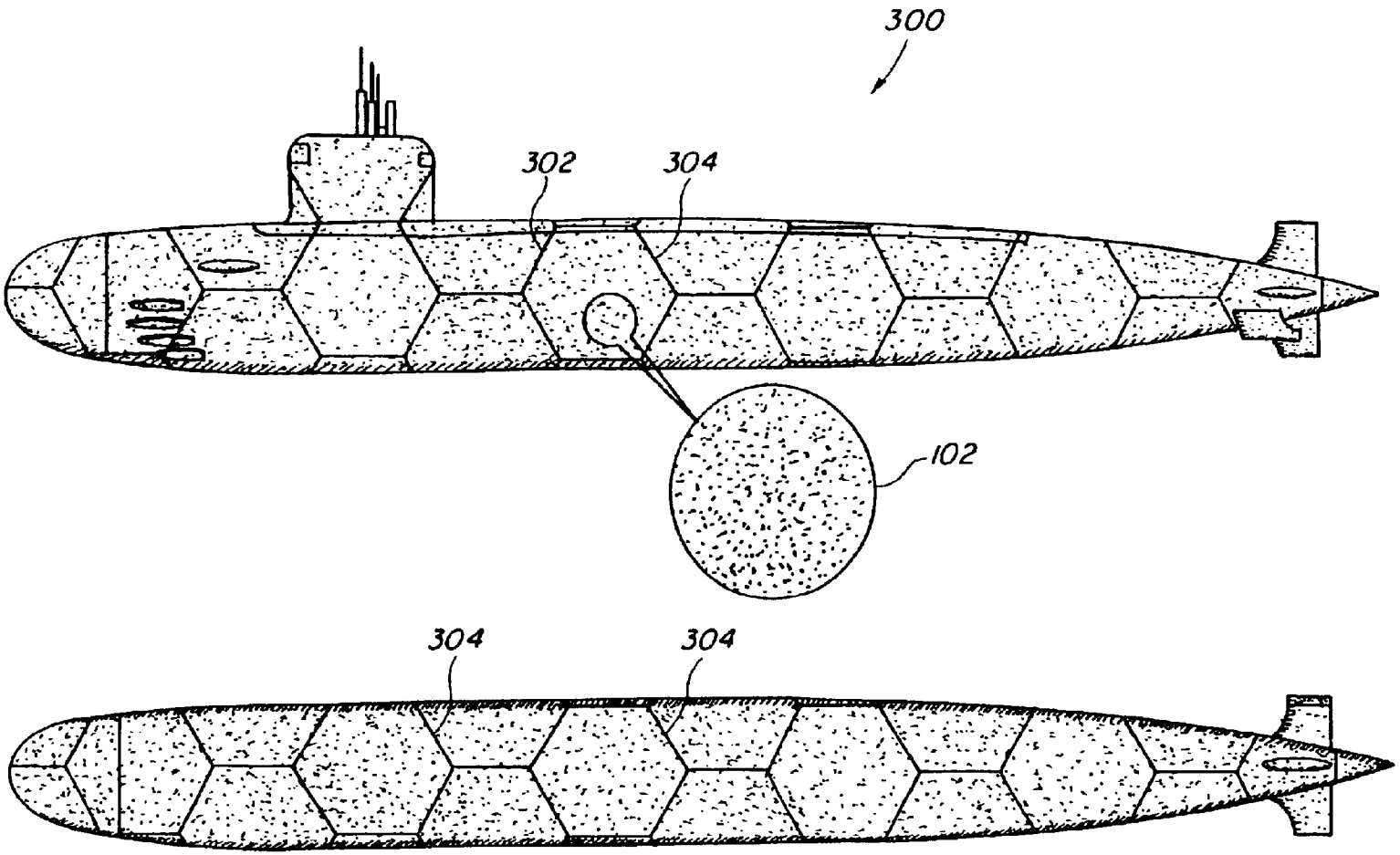
FIG. 3 is a schematic showing the global distribution of communication cells which include the sensor/radio units illustrated as in FIG. 2, with an area of enlargement shown to illustrate the distribution of sensors/radio units within a typical region.

Referring now to FIG. 1, there is shown a schematic of a planar waveguide 100 formed on the outer surface of a hull of a vessel in an exemplary embodiment of the present invention. The waveguide 100 comprises an outer dielectric layer 106, an optional (as discussed further below) metal coat layer 108, an inner dielectric layer 110, and the outer surface 112 of a hull 302 (FIG. 3). The dielectric layer 106 may be up to several inches thick, and layers 108 and 112 are conductive layers sandwiching the dielectric layer 110 that in some embodiments together form some of the important elements of the waveguide 100. For example, in the case of application to steel hulls, the conductivity of the hull 302 may be sufficient to have the hull act as one conductive sheet. However, the dissipative losses occurring with waveguides 100 that are designed to operate at certain higher frequencies, e.g. above about 1 GHz, typically necessitate the presence of the additional outer conductive layer 108 on waveguide 100.

To first approximation, the waveguide 100 is planar in that the curvature of the body of the waveguide 100 is small compared to the electromagnetic wavelengths. The spatial modes that are relevant for RF propagation are the TEM, $TE_1$, and $TM_1$ modes. The $TE_1$ and the $TM_1$ modes are the most highly attenuated. The inner dielectric layer 110 includes self-powered sensors 102 with radio/cellular communication capabilities. The sensors 102 are preferably used to measure physical parameters such as, for example, acoustic pressure and acceleration, electric/magnetic fields, temperature, and hydrostatic pressure. Information collected by the sensors 102 is received by a cellular base station 104 via RF propagation within the electromagnetic waveguide 100 from where it is communicated to central processing station 402 (FIG. 4) for further processing of the collected data.

The sensors 102 may be powered by scavenging energy from the environment. For example, this may be accomplished by, and is not limited to, the charging of Lithium-ion, or other high energy density battery, through the extraction of energy from (a) the thermal gradient that exists between the interior of a vessel, for example, such as a ship and the surrounding water; (b) the mechanical energy imparted to the structure of a vessel by the action of waves (in the case of a surface ship); (c) the mechanical energy imparted to the structure by the changing depth (for the case of a submarine); (d) the mechanical energy that is a part of a flow field around a vessel, and (e) the extraction of direct broadcast RF power. The above methods are merely exemplary and therefore the present invention should not be construed to be limiting of any specific method.

The present invention provides for a wireless method of distributing a large number of sensors 102 that makes possible the application of a number of algorithms in order to extract various physical quantities. For example, in the case of acoustic sensing, an algorithm that uses dynamic pressure and acceleration measured at the sensor sites as inputs is used to directly compute Helmholtz integral. The large number of sensors also enables the spatial sampling demanded by the structural acoustics. The spatial sampling requirements for the measurement of other quantities may be established by the physics of the problem of interest, the highest sampling density being observed to be required by the acoustic applications. The array sensors 102 may be installed and configured to measure several physical quantities simultaneously.

Figure 2:
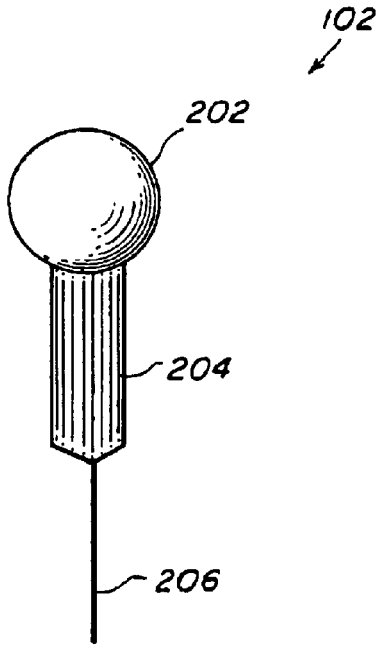
FIG. 2 illustrates a schematic of a sensor/radio unit that is arrayed in large numbers within the waveguide illustrated in FIG. 1.

FIG. 2 illustrates the structure of a sensor/radio unit 102 shown in FIG. 1. Sensor 102 is shown to include a sensor head 202, radio frequency (RF) electronic signal conditioning circuitry 204, and an antenna 206. Sensors 102 measure physical quantities and the measured data/information received by the sensors is communicated via the electromagnetic waveguide 100 to a base station. From the base station, the received measurements may be communicated to a central processing station, which may, for example, be disposed remote from the base station. Thus, the conformal waveguide 100 provides an electromagnetic communications medium, for example in the 1 MHz to 10 GHz range, for use on the exterior of hull forms. The carrier frequency is determined by the overall bandwidth of the system. For example, an 8-bit system with 10,000 sensors (each having 20 KHz of bandwidth) has an overall bandwidth requirement of approximately 1.5 GHz. For example, at microwave frequencies, water is very lossy to electromagnetic energy and the creation of the waveguide 100 allows RF communication to take place in this lossy environment.

The architecture of the communications system may use cellular radio engineering practices that include either analog or digital implementations. However, the preferred embodiment of the present invention uses a digital format where the physical quantities measured by the sensors 102 are converted to digital information and then transmitted via a Code Division Multiple Access (CDMA). CDMA is a modulation and multiple access scheme based on spread spectrum techniques. This configuration of the system may be robust while requiring less power to function.

The sensors 102 may be arranged on the surface of a structure in cells 304 as illustrated in FIG. 3. The structure of a vessel 300 may comprise a plurality of such cells 304 arranged on a hull surface 302 of the vessel 300. The boundaries shown for the cells 304 are depicted not to indicate physical structural boundaries but instead to indicate cell logical boundaries.

The overall system of the present invention enables the formation of, for example, a large array of sensors 102 on the exterior of a structure to monitor the acoustic and electromagnetic fields with sufficient density to support direct determination of the radiated and scattered fields with sufficient density to support direct determination of the radiated and scattered fields, and thus the signature of a vessel. Further, the array of sensors 102 of the present invention serves as a global sonar with performance far exceeding the existing sonar technology. Such an implementation is otherwise not feasible by use of other known techniques to interconnect the sensors 102 given the significant cost, weight, and space impact associated with cabling.

The overall thickness of waveguide 100 depends on the specific application and is also dependent on factors that include the types and physical dimensions of the sensors 102, the desired waveguide modal properties, and signal-to-noise ratio. The topology of waveguide 100 may vary due to various design considerations that include hydrodynamics, acoustics, and thermal areas. Accordingly, the thicknesses of layers 106, 108, and 110 may also vary due to such considerations. Also, another layer or layers may be included in or on waveguide 100 provided it does not substantially interfere with the desired system performance. For example, an additional layer positioned on the outer surface of waveguide 100 is usually not detrimental to performance.

As an example, considering the case of a small AUV, an individual cell might access sensors located within approximately a half meter radius. At the high RF frequencies involved, the high absorption in water necessitates the introduction of a suitable waveguide material to allow sufficient propagation even over these modest base-cell distances. The field strength of the lowest TEM order mode is proportional to the following factors $$G \sim c/2\sqrt{\in/\in_0}\pi^2 f\, r\, e^{-\pi f\sqrt{\in\mu}\, r \tan\delta}$$

where c is the speed of light, $\in$ is the dielectric constant, f the frequency, r the propagation distance, $\mu$ the permeability, and $\delta$ the loss factor. The above equation indicates that what is desired is a material with a low index of refraction and a low loss factor. In water, the RF signal decays by $10^{-5}$ in 1 cm. This compares to 2 m, 12 m, 20 m, and 1 km for polyurethane, nylon, Teflon, and Styrofoam, respectively. Thus, a layer of a material of this type would provide a, sufficiently low loss medium in which to propagate the sensor-to-base cell signals. Further, the thickness of the material is selected by a number of factors that include being able to accommodate all, or a portion of, the dimensions of the sensor-radio unit and a need to place high spatial order modes in cutoff so that they do not carry energy.

As another example, consider an acoustic scattering monitor for a submarine where the acoustic sensors are arrayed on the surface of the structure at spatial intervals established by a Nyquist criteria applied to a wavenumber-frequency dispersion relations. In its simplest form, an acoustic scattering monitor is accomplished through application of the Helmholtz integral:

$$p = \oint_s \left( p_s \frac{\partial G}{\partial n} - iw\rho v_s G \right) ds$$

where $p_s$=pressure on the surface of the structure (for example, submarine);

$v_s$=normal velocity on the surface of the structure;

p=off-board desired pressure; and

G=free-space Green's function

Here, $p_s$ and $v_s$ are the measured quantities from the sensor array. In a practical application, for example, the integration is simply cast in a discrete format and the offboard pressure is computed. In general, acoustic radiation monitor, sonar systems, and electromagnetic signatures are accomplished in a similar closed-form surface integral format.

Figure 4:
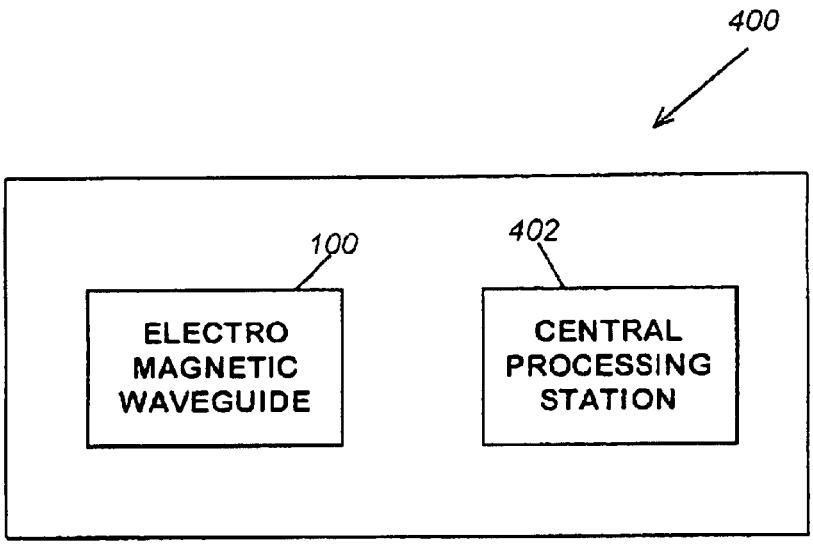
FIG. 4 is a schematic of a hull-based sensor system communicating with a central processing system for processing data receiving by the hull-based sensor system in an exemplary embodiment of the present invention.

FIG. 4 illustrates a schematic of the overall system 400 of the present invention which includes the electromagnetic waveguide 100 (FIG. 1) and a central processing station 402 that receives information from the sensors 102 disposed within the waveguide 100.

Figure 5:
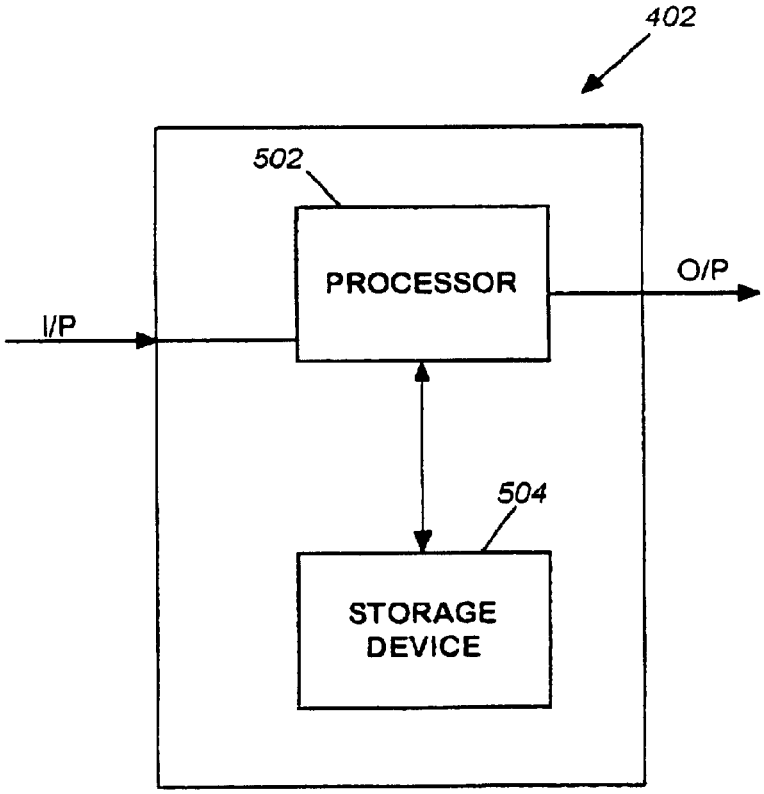
FIG. 5 illustrates exemplary details of the central processing station illustrated in FIG. 4.

FIG. 5 illustrates a schematic of the central processing station 402. The central processing station 402 may include such components as, for example, a processor 502 for processing information received from the sensors, and a storage device 504 for storing information received from the sensors 102 as well as for storing information processed by the processor 502. The processed information is displayed as output. Although the central processing station 402 is shown to include only a processor and a storage device, it will be appreciated that the central processing station may be in the form of a typical server computer system with a capability to perform a multitude of server related functions.

The present invention has a number of widespread applications that include, but are not limited to the following:

(1) a system for monitoring the scattered and radiated acoustic signals from submarines, torpedoes, Autonomous Underwater Vehicles (AUV), Unmanned Underwater Vehicles (UUV), and surface ships as those signals would appear at physical locations off of the structure (for example, at an enemy's sonar);

(2) a system for monitoring the electromagnetic field associated with submarines and surface ships as that field might appear to a sea mine or surveillance system;

(3) a system for monitoring the distribution of temperatures and hydrostatic pressures on the surface of submarines and surface ship hulls;

(4) a system for evaluating and diagnosing the temporal and spatial detail of the vibro-acoustic response of a structure to be controlled actively or passively, with Nearfield Acoustic Holography tools being employed for the latter.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for performing spatially dense measurements of physical quantities at a structure-fluid interface, comprising:

an electromagnetic waveguide formed on an external surface of a vessel;

a plurality of wireless sensors disposed within the electromagnetic waveguide for sampling the physical quantities and receiving measurements thereof, and one or more radio receivers disposed within said waveguide for communicating with said plurality of wireless sensors to extract measurements of physical quantities therefrom.

2. The system as in claim 1, wherein spatially dense measurements are performed exterior of the vessel.

3. The system as in claim 2, wherein the plurality of wireless sensors are capable of supporting spatial sampling demanded by structural acoustics of the vessel.

4. The apparatus as in claim 2, wherein the plurality of sensors are arranged on an external structural surface of the vessel in the form of cells.

5. The apparatus as in claim 1, wherein each sensor of the plurality of wireless sensors comprises:

an RF signal conditioning circuitry; and an antenna for enabling communication with remote devices.

6. The apparatus as in claim 1, wherein the electromagnetic waveguide provides a communication medium in the range of from about 1 MHz to about 10 GHz.

7. The apparatus as in claim 1, wherein the electromagnetic waveguide is planar in configuration such that the curvature of the waveguide is less than an electromagnetic wavelength of the waveguide.

8. The apparatus as in claim 1, wherein the electromagnetic waveguide comprises a dielectric layer, and a conductive layer positioned on each side of the dielectric layer.

9. The apparatus as in claim 8, wherein the plurality of sensors are disposed within said dielectric layer to sample physical quantities exterior of said vessel.

10. The apparatus as in claim 8, wherein said physical quantities include at least one of hydrostatic pressure, temperature, electric and magnetic fields, and dynamic and static accelerations.

11. The apparatus as in claim 1, wherein information received by said plurality of wireless sensors is communicated to a central processing station via radio frequency communication.

12. The system according to claim 1, wherein the electromagnetic waveguide includes at least one dielectric material layer formed on the external surface of the vessel.

13. The system according to claim 1, wherein the plurality of wireless sensors are disposed within the at least one dielectric material layer.

14. A method for performing spatially dense measurements of physical quantities at a structure-fluid interface, the method comprising:

forming an electromagnetic waveguide on an external surface of a vessel;

providing a plurality of wireless sensors within the electromagnetic waveguide for sampling physical quantities outside of the vessel and receiving data related to the physical quantities; and providing one or more radio receivers within said waveguide for communicating with said plurality of wireless sensors to extract data received by said plurality of wireless sensors.

15. The method as in claim 14, wherein spatially dense measurements are performed exterior of the vessel.

16. The method as in claim 14, wherein the plurality of sensors are capable of supporting spatial sampling demanded by structural acoustics of the vessel.

17. The method as in claim 14, further comprising:

providing each of plurality of sensors with RF signal conditioning circuitry and with an antenna for enabling communication with remote devices.

18. The method as in claim 14, wherein the electromagnetic waveguide provides a communication medium in the range of from about 1 MHz to about 10 GHz.

19. The method as in claim 14, wherein the electromagnetic waveguide is planar in configuration such that the curvature of the waveguide is less than an electromagnetic wavelength of the waveguide.

20. The method as in claim 14, wherein the electromagnetic waveguide comprises a dielectric layer, and a conductive layer positioned on each side of the dielectric layer.

21. The method as in claim 20, further comprising:

disposing the plurality of wireless sensors within the dielectric layer to sample physical quantities exterior of said vessel.

22. The method as in claim 21, further comprising:

communicating information received by the plurality of wireless sensors to a central processing station via radio frequency communication.

* * * * *